US011464266B2

(12) United States Patent
Kositchiranant et al.

(10) Patent No.: US 11,464,266 B2
(45) Date of Patent: Oct. 11, 2022

(54) APPAREL HAVING A WAIST PORTION AND SLEEVES WITH A THUMBHOLE

(71) Applicant: Under Armour, Inc., Baltimore, MD (US)

(72) Inventors: Paridee Kositchiranant, Baltimore, MD (US); Jessica Burkhardt, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 0 days.

(21) Appl. No.: 16/791,280

(22) Filed: Feb. 14, 2020

(65) Prior Publication Data

US 2021/0251322 A1 Aug. 19, 2021

(51) Int. Cl.

| | |
|---|---|
| ***A41D 31/18*** | (2019.01) |
| ***A41D 1/08*** | (2018.01) |
| ***A41D 27/10*** | (2006.01) |

(52) U.S. Cl.

CPC ..... *A41D 31/185* (2019.02); *A41D 1/08* (2013.01); *A41D 27/10* (2013.01)

(58) Field of Classification Search

CPC .... A41D 31/185; A41D 13/0015; A41D 1/06; A41D 1/08; A41D 2400/80; A41D 2400/82; A41D 27/20; A41B 11/14; A41B 9/14; A41B 9/02; A41B 2400/80; A41B 2400/82; A41F 9/00

USPC ..... 2/236, 237

See application file for complete search history.

(56) References Cited

U.S. PATENT DOCUMENTS

| | | | | |
|---|---|---|---|---|
| 3,253,599 | A * | 5/1966 | Bjorn-Larsen | A41B 11/128 450/104 |
| 3,854,978 | A * | 12/1974 | Campbell, Sr. | D06N 7/0092 427/375 |
| 3,930,090 | A * | 12/1975 | Campbell, Sr. | A41F 9/00 428/196 |
| 10,010,115 | B2 * | 7/2018 | Carlson | A41B 1/08 |
| 10,315,392 | B2 * | 6/2019 | Arici | B32B 27/22 |
| 2011/0145980 | A1 * | 6/2011 | D'Alessandro | A41D 27/20 2/254 |
| 2012/0036615 | A1 * | 2/2012 | Bradstreet | A41D 1/08 2/236 |
| 2012/0210495 | A1 * | 8/2012 | Wilson | A41F 9/025 2/236 |
| 2013/0007947 | A1 * | 1/2013 | Moore | A41F 9/02 2/236 |
| 2013/0305433 | A1 * | 11/2013 | Hedrick | A41D 31/185 2/220 |

(Continued)

*Primary Examiner* — Katherine M Moran
*Assistant Examiner* — Haley A Smith
(74) *Attorney, Agent, or Firm* — Maginot, Moore & Beck LLP

(57) ABSTRACT

A garment includes a waistband having a first layer and a second layer. The first layer includes a concealed surface and an exposed surface. The exposed surface of the first layer configured to be in contact with a skin of a wearer. The second layer includes a concealed surface and an outer portion. The second layer secured to the first layer at an upper and a lower end to form the waistband. The garment further includes a first layer of polymer disposed on the concealed surface of the first layer and a second layer of polymer material disposed on the concealed surface of the second layer such that the first layer releasably engages the second layer.

20 Claims, 18 Drawing Sheets

(56) References Cited

U.S. PATENT DOCUMENTS

| | | | | |
|---|---|---|---|---|
| 2015/0007379 | A1* | 1/2015 | Cockram | A41D 13/0015 2/236 |
| 2016/0135528 | A1* | 5/2016 | Baschak | A41F 9/00 2/244 |
| 2016/0157529 | A1* | 6/2016 | Hoeven | A41B 11/128 2/240 |
| 2016/0286866 | A1* | 10/2016 | Carlson | A41B 1/08 |
| 2018/0110275 | A1* | 4/2018 | Moffa | A41F 9/02 |
| 2018/0111668 | A1* | 4/2018 | Tortorice | B63C 11/04 |
| 2018/0206567 | A1* | 7/2018 | Diakonov | A41D 13/0012 |
| 2018/0271177 | A1* | 9/2018 | McGuire | A41B 11/14 |
| 2020/0315265 | A1* | 10/2020 | Huang | A41B 9/02 |

* cited by examiner

APPAREL HAVING A WAIST PORTION AND SLEEVES WITH A THUMBHOLE

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD

This application relates to the field of garments and other apparel, including pants and shirts.

BACKGROUND

Athletic garments are commonly worn by individuals participating in athletic activities. During an athletic activity, portions of garments sometimes become displaced. For example, workout pants, and particularly pants that extend below the knee of the wearer, may pull down at the rear waistband during an activity, causing embarrassment and discomfort. This can also lead to eventual abandonment of the athletic activity since it is distracting when the athletic garment needs to readjusted or pinched constantly. In other embodiments, sleeves may unintentionally roll up or ride higher due to arm movement. Again, this unwanted movement of the garment is distracting and requires repeated attention.

In another example, sleeves of a garment can ride up along the arms. For example, sleeves can ride up and bunch up when layering additional garments. Sleeves can also ride up and expose skin above a glove during colder weather. Sleeves can also ride up when the wearer is trying to put on gloves. This can cause discomfort and can also leave portion of the hands cold.

In view of the foregoing, it would be advantageous to provide an improved apparel that allow the wearers to perform athletic activities without distractions and discomfort.

SUMMARY

In accordance with one embodiment of the disclosure, there is provided a garment comprising a waistband that includes a first layer a second layer. The first layer has a concealed surface and an exposed surface. The exposed surface of the first layer is configured to be in contact with a skin of a wearer. The second layer includes a concealed surface and an exposed surface. The second layer is secured to the first layer at an upper and a lower end to form the waistband. The garment further comprises a first layer of polymer disposed on the concealed surface of the first layer. The garment further comprises a second layer of polymer material disposed on the concealed surface of the second layer such that the first layer releasably engages the second layer. The garment further comprises at least one fabric panel coupled to the waistband.

Pursuant to another embodiment of the disclosure, there is provided a sleeve garment for a garment to be worn by a human. The sleeve comprises a distal end opposite a proximal end. The sleeve further comprises a primary sleeve panel extending to the distal end of the sleeve. The primary sleeve panel includes a circuitous first edge on the distal end of the sleeve. The first edge has a recessed portion extending along a thumb side of the first edge and an extended portion extending along a pinky side of the first edge. The extended portion is more distal on the sleeve than the recessed portion such that the recessed portion defines an indentation along the first edge. A secondary sleeve panel is connected to the primary sleeve panel at a seam arranged along the first edge such that an overlap between the primary sleeve panel and the secondary sleeve panel is formed along the seam. The secondary sleeve panel extends across the recessed portion of the first edge and fills the indentation such that the primary sleeve panel and secondary sleeve panel together form a distal edge of the sleeve. The sleeve further includes a passage through the seam formed at the thumb side of the first edge, the passage through the seam designed and dimensioned to receive a thumb of the human.

The above described features and advantages, as well as others, will become more readily apparent to those of ordinary skill in the art by reference to the following detailed description and accompanying drawings. While it would be desirable to provide a garment with a waist portion and sleeves with a thumbhole that provides one or more of these or other advantageous features, the teachings disclosed herein extend to those embodiments which fall within the scope of the appended claims, regardless of whether they accomplish one or more of the above-mentioned advantages.

BRIEF DESCRIPTION OF THE DRAWINGS

The foregoing aspects and other features of an apparel are explained in the following description, taken in connection with the accompanying drawings.

Figure 1A:
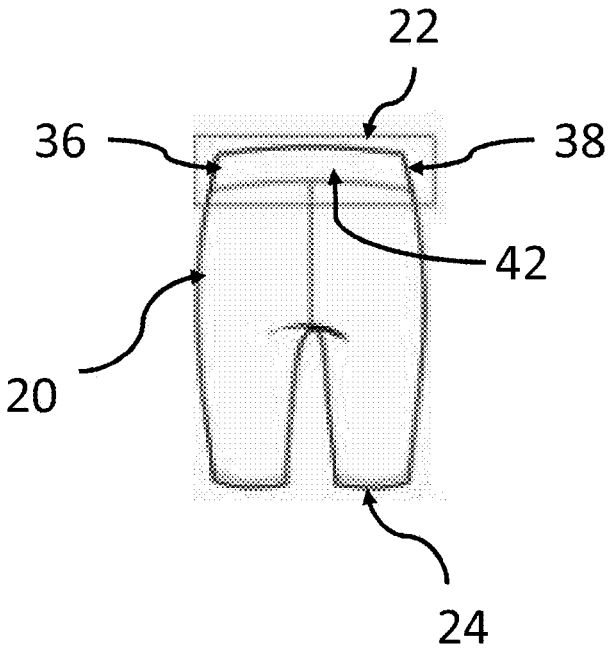
FIG. 1A is a rear view of an exemplary embodiment of a garment with a waistband having a textured interior portion.

All Figures © Under Armour, Inc. 2019. All rights reserved.

DESCRIPTION

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

Waistband for Garment

With reference to FIGS. 1-4, an exemplary embodiment of a garment 20 with a waistband 22 having a textured interior surface is disclosed. The garment 20 includes a waistband 22 and at least one fabric panel 24 coupled to the waistband 22. As discussed in further detail below, the textured interior surface is provided along a rear stretch of the waistband 22, and is configured to improve the stability of the garment during an activity.

Figure 1B:
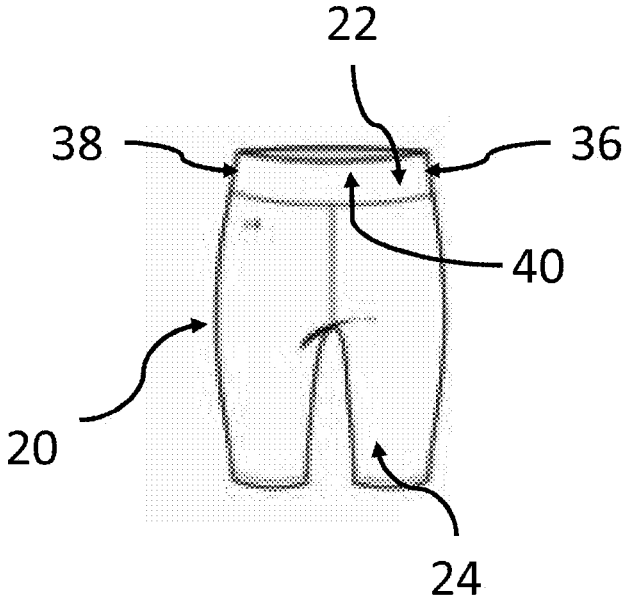
FIG. 1B is a front view of the garment of FIG. 1A.
Figure 1C:
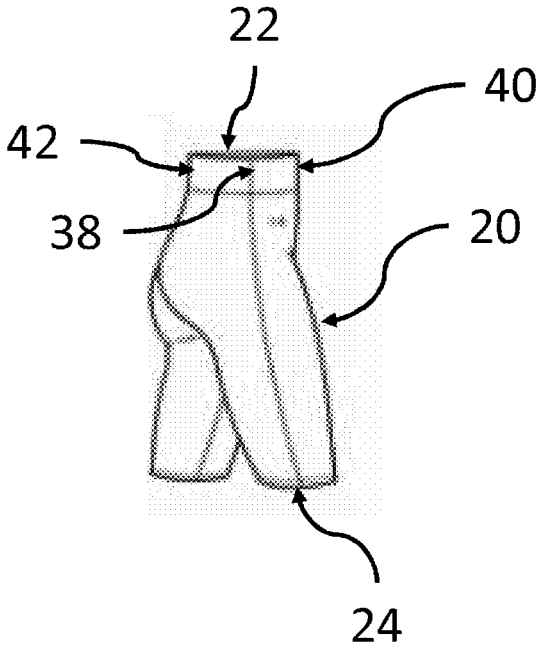
FIG. 1C is a side view of the garment of FIG. 1B.

With particular reference now to FIGS. 1A-1C, in at least one embodiment, the garment 20 is a garment configured to be worn on the lower portion of a human body, such as a pair of compression shorts, yoga pants, slacks, or any of various other types of pants or shorts. In such embodiments, the waistband 22 is arranged at or near the top of the garment 20, and the fabric panels 24 extend downward from the waistband 22. The waistband 22 includes a front portion 40 and a rear portion 42, each of which extends between a left seam 36 and a right seam 38. The front portion 40 of the waistband 22 may be formed from a single layer of a textile material. However, as explained in further detail below, the rear portion 42 of the waistband 22 (which may also be referred to herein as a "rear waistband portion") includes two layers of a textile material and a textured inner surface.

The one or more fabric panels 24 are connected to the waistband 22 and form portions of the garment 20 configured to cover the lower torso (e.g., pelvis, buttocks, etc.) and the legs of the wearer. Accordingly, the fabric panels may include a number of different panels such as leg panels, pelvis panels, buttocks panels, etc. The fabric panels 24 may be coupled together and to the waistband 22 using any of various means such as adhesives, stitching, welding, etc.

Figure 2:
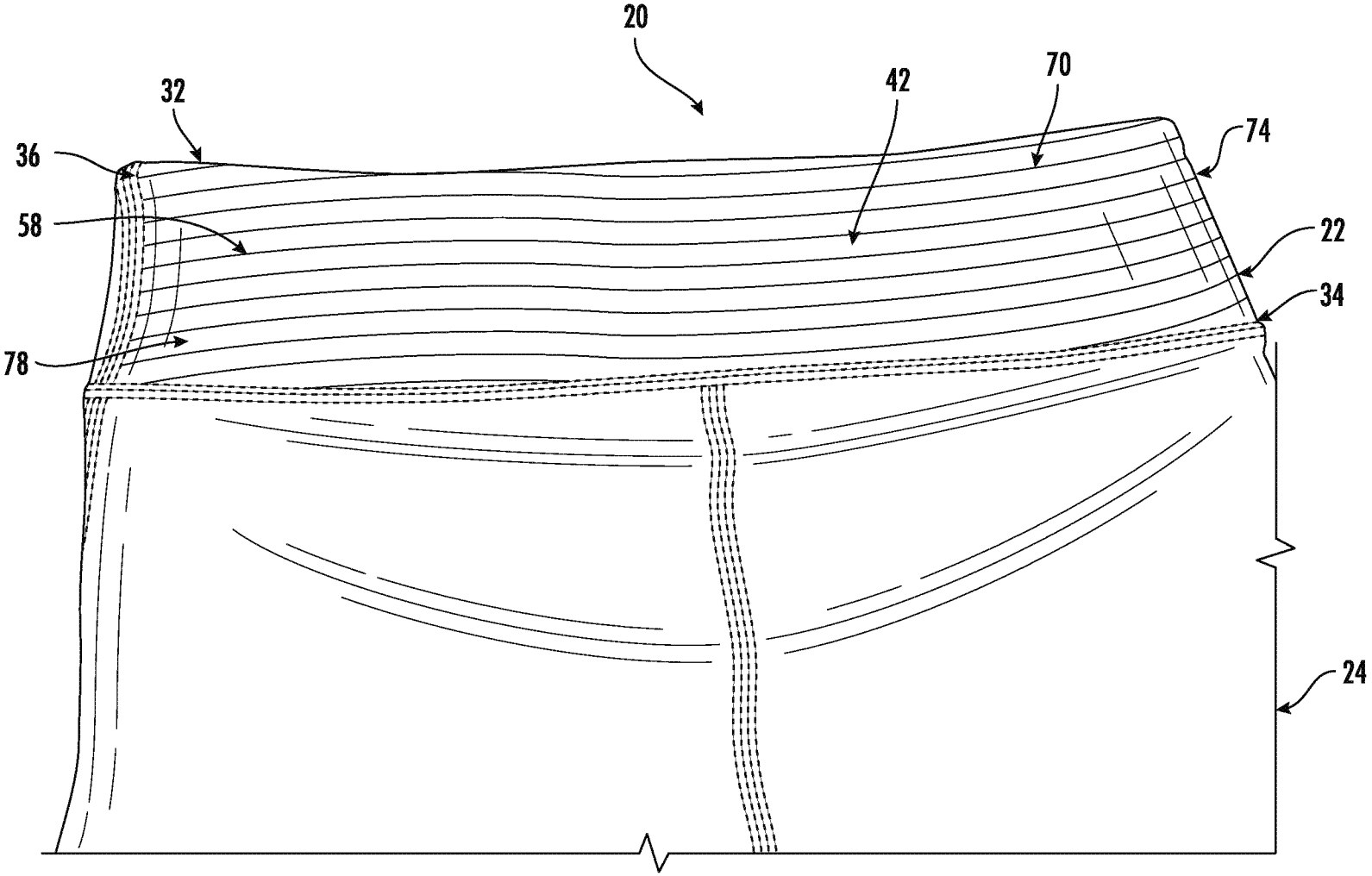
FIG. 2 shows a perspective view of an exemplary embodiment of an exterior (outside) view of a rear portion of the garment and the waistband of FIG. 1A.

FIG. 2 shows an exemplary embodiment of an exterior (outside) view of a rear portion of the garment 20. As shown in FIG. 2, the waistband 22 forms an upper portion of the garment 20 and includes an upper edge 32 and a lower seam 34 (which defines a lower edge of the waistband 22). The rear portion 42 of the waistband extends along the back side of the garment 20 between the left seam 36 and the right seam 38. The rear portion 42 of the waistband is particularly configured to extend across a lumbar region of a back of the wearer. Accordingly, the rear portion 42 of the waist band extends from a left side to a right side of the wearer, across a region that includes one or more of the five lumbar vertebrae of the human spine.

As explained in further detail below, the rear portion 42 of the waistband 22 is dual-layered and includes a first textile layer 50 (i.e., an innermost layer not shown in FIG. 2), and a second textile layer 70 (i.e., an outermost layer). In at least one embodiment, the first textile layer 50 and the second textile layer 70 are both comprised of an elastic textile material, such as spandex or other material having elastane fibers. As a result, both the first textile layer 50 and the second textile layer 70 are advantageously elastic and capable of resilient stretching. While layers 50 and 70 are both disclosed herein as being comprised of a textile material, it will be recognized that in some embodiments at least one of the first and second layers 50 and 70 may be comprised of a non-textile, such as a leather or multi-layer laminate structure.

Both the first textile layer 50 and the second textile layer 70 are generally rectangular in shape and similarly sized such that the two layers may be aligned and coupled together along their respective edges to form the rear portion 42 of the waistband 22. When the first textile layer 50 and the second textile layer 70 are coupled together, an inner/concealed surface of the first textile layer 50 faces an inner/concealed surface of the second textile layer 70, and a closed pocket 44 (not show in FIG. 2) is formed between the two layers 50, 70. Advantageously, as described in further detail below, the concealed surfaces of the first textile layer 50 and the second textile layer 70 are textured. Although the pocket 44 of the waistband 22 is closed in the exemplary embodiment disclosed herein (i.e., there is no opening to the pocket), the textured interior of the waistband 22 is both visibly and tactilely perceptible by a human from an exterior of a rear surface 26 of the waistband 22. As described in further detail herein, in at least one embodiment the waistband 22 includes one or more layers of polymer material in the form of polymer structures disposed on one or more surfaces. In at least some embodiments, the polymer structures are defined by a series of overlapping wavy lines that work together to provide stability to the waistband 22.

Figure 3:
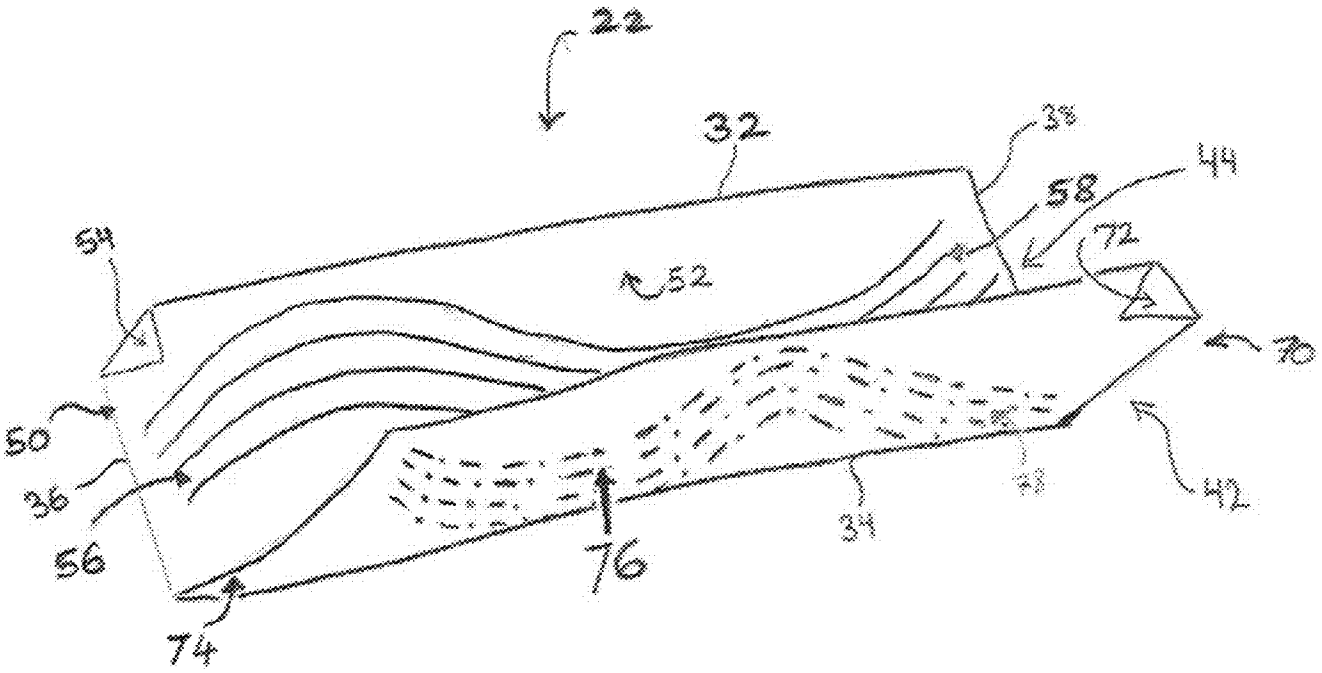
FIG. 3 is an opened perspective view of the rear portion of the waistband of FIG. 2.

With reference now to FIG. 3, an exemplary embodiment of the rear portion 42 of the waistband 22 is shown with the waistband in an open configuration in order to expose the pocket 44 defined between the inner surfaces of the first textile layer 50 and the second textile layer 70. In particular, in FIG. 3, the waistband 22 is shown as opened along the upper edge 32, the left seam 36, and the right seam 38 in order to expose the concealed surface 52 of the first textile layer 50. However, it will be recognized that when the waistband 22 is arranged on the garment, the first textile layer 50 and the second textile layer 70 are secured together on the upper edge 32, the lower seam 34, the left seam 36, and the right seam 38. The first textile layer 50 includes both the concealed surface 52 and an exposed surface 54, with the exposed surface 54 positioned on an opposite side of the first textile layer 50 from the concealed surface 52. In at least one embodiment, the exposed surface 54 of the first textile layer 50 is in contact with the skin of the wearer when the wearer is wearing the garment 20 such as the skin near the belly or hips of the wearer. The second textile layer 70 also includes a concealed surface 72 and an exposed surface 74. The exposed surface 74 of the second textile layer 70 may be visible from an exterior perspective, such as shown in FIG. 2.

With continued reference to FIG. 3, the first textile layer 50 includes a first polymer structure 56 disposed on the concealed surface 52 of the waistband 22. The second textile layer 70 also includes a second polymer structure 76 disposed on the concealed surface 72 of the second textile layer 70. The second polymer structure 76 is shown in dashed and dotted lines in FIG. 3 since it is on the concealed surface 72 and not immediately visible from the perspective shown in FIG. 3. As explained in further detail below, the first polymer structure 56 and the second polymer structure 76 both have a depth, and at least some portions of the first and second polymer structures 56, 76 may be overlapping. The depth of the polymer structures 56, 76 and their configuration contribute to an additional depth of the waistband 22. In one example, the first polymer structure 56 and the second polymer structure 76 are not visible when the garment 20 is viewed from an exterior perspective. In another example, an outline of a portion of the first polymer structure 56 and the second polymer structure may be visible when the garment 20 is viewed from an exterior perspective and/or tactilely perceivable when the exterior of the waistband 22 is touched.

The first and second polymer structures 56 and 76 are both comprised of a polymer material disposed on the concealed surfaces 52 and 72. For example, the polymer material may be a polyurethane (PU), silicone, or any of various other polymer materials, including any of various thermoplastic elastomers (TPE) such as PVC, PVA, PU, etc. In such embodiments, the polymer structures 56 and 76 may be deposited and cured on the waistband using any of various known techniques such as three-dimensional or screen printing, and/or air or UV curing processes. In at least one embodiment, a silicone print is particularly advantageous for providing the first and second polymer structures 56 and 76, as it is resistant to cracking when exposed to water and heat, thus providing excellent durability following repeated washings and wear. Notwithstanding the structures 56 and 76 being described in the exemplary embodiment herein as "polymer" structures, it will be recognized that in at least some embodiments the structures 56 and 76 may be provided by different non-polymer materials. For example, in at least some embodiments, the structures 56 and 76 may be provided by cotton yarns or other yarns made of natural fibers that are embroidered or otherwise stitched or incorporated into the waistband.

In addition to the foregoing, it will be recognized that in various embodiments the first polymer structure 56 can be disposed in any portion of the first textile layer 50, and the second polymer structure 76 can also be disposed in any portion of the second textile layer 70. In the exemplary embodiment disclosed herein, the first polymer structure 56 is disposed in the middle portion of the first textile layer 50 (i.e., between the upper edge 32 and the lower edge/seam 34), and the second polymer structure 76 is similarly disposed in the middle portion of the second textile layer 70. In this example, the first polymer structure 56 and the second polymer structure 76 each extends from the left seam 36 to the right seam 38 on the waistband 22. Additionally, because the pocket 44 is formed between the first textile layer 50 and the second textile layer 70, the two textile layers 50, 70 may be moved relative to one another outside of the edge/seams 32, 34, 36, 38 of the waistband. Accordingly, the first polymer structure 56 is freely moveable relative to the second polymer structure 76 within the pocket 44 (other than at the edges/seams 32, 34, 36, 38 or other locations where the two textile layers 50, 70 are coupled together) While the exemplary embodiment disclosed herein describes the polymer structures 56, 76 as being provided on the concealed surfaces 52, 72 within the pocket 44, it should be understood that the polymer structures can be disposed in other parts of the garment 20 or in different locations of the waistband 22 such as the exposed surface 54 of the first textile layer 50 directly contacting the skin.

As mentioned previously, both the first polymer structure 56 and the second polymer structure 76 are defined by a depth/thickness defined by a dimension that extends outwardly from the associated concealed surface 52, 72 of the waistband 22. In at least one embodiment, the depth of each of the first and second polymer structures 56 and 76 is between 0.3 and 0.7 mm, and particularly about 0.5 mm. However, in other embodiments, the depth of the polymer structures 56 and 76 may be different, such as a depth between 0.1 and 1.0, between 1.0 and 2.0 mm, or greater than 2.0 mm. When the waistband 22 is assembled and the first and second polymer structures 56, 76 are overlaid on one another and overlap, the total depth of the polymer structures adds additional depth to the waistband 22 in addition to the first and second textile layers 50, 70.

As noted above, when the first textile layer 50 and the second textile layer 70 are secured in the waistband, at least a portion of the first polymer structure 56 and a portion of the second polymer structure 76 engage with each other. However, the first and second polymer structures 56, 76 are distinct and connected to opposite surfaces 52, 72 within the pocket 44. Thus, because the first and second polymer structures 56, 76 are not directly coupled together, the first polymer structure 56 releasably engages with the second polymer structure 76 within the pocket 44. When a portion of the first polymer structure 56 engages with a portion of the second polymer structure 76, depending upon the material of the first polymer structure 56 and the second polymer structure 76 and/or the first pattern 58 and the second pattern 78, the portion of the first polymer structure 56 and second polymer structure 76 that are in contact with each other do not easily slide with respect to each other. As such, when a portion of the first polymer structure 56 engages with a portion of the second polymer structure 76, it provides stability for the garment 20, and particularly stability in the waistband, and improved mobility for the user. Advantageously, a portion of the texture of the first polymer structure 56 and the second polymer structure 76 may be felt on the exposed surface 54 of the first textile layer 50. When the skin of the wearer comes in contact with the portion of texture of the first polymer structure 56 and the second polymer structure 76 on the exposed surface 54 of the first textile layer 50, the texture comfortably engages the skin of the user, but does not easily slide against the surface of the skin. This will provide stability for the garment 20 when the wearer is engaging in an activity.

In view of the foregoing, it will be recognized that the arrangement of the polymer structures 56, 76 in the waistband 22 allow the garment 20 to stay in place and not ride up or sag down when the wearer is performing an activity. In one example, the resulting pattern 58, 78 in the polymer structures 56, 76 can also provide an aesthetic look from an outside perspective. For example, the resulting pattern 58, 78 when viewed from an exterior perspective can look like a combination of straight lines, wavy lines, zigzag lines, spirals, different shapes, outline of objects, outline of logos, or the like.

Figure 4:
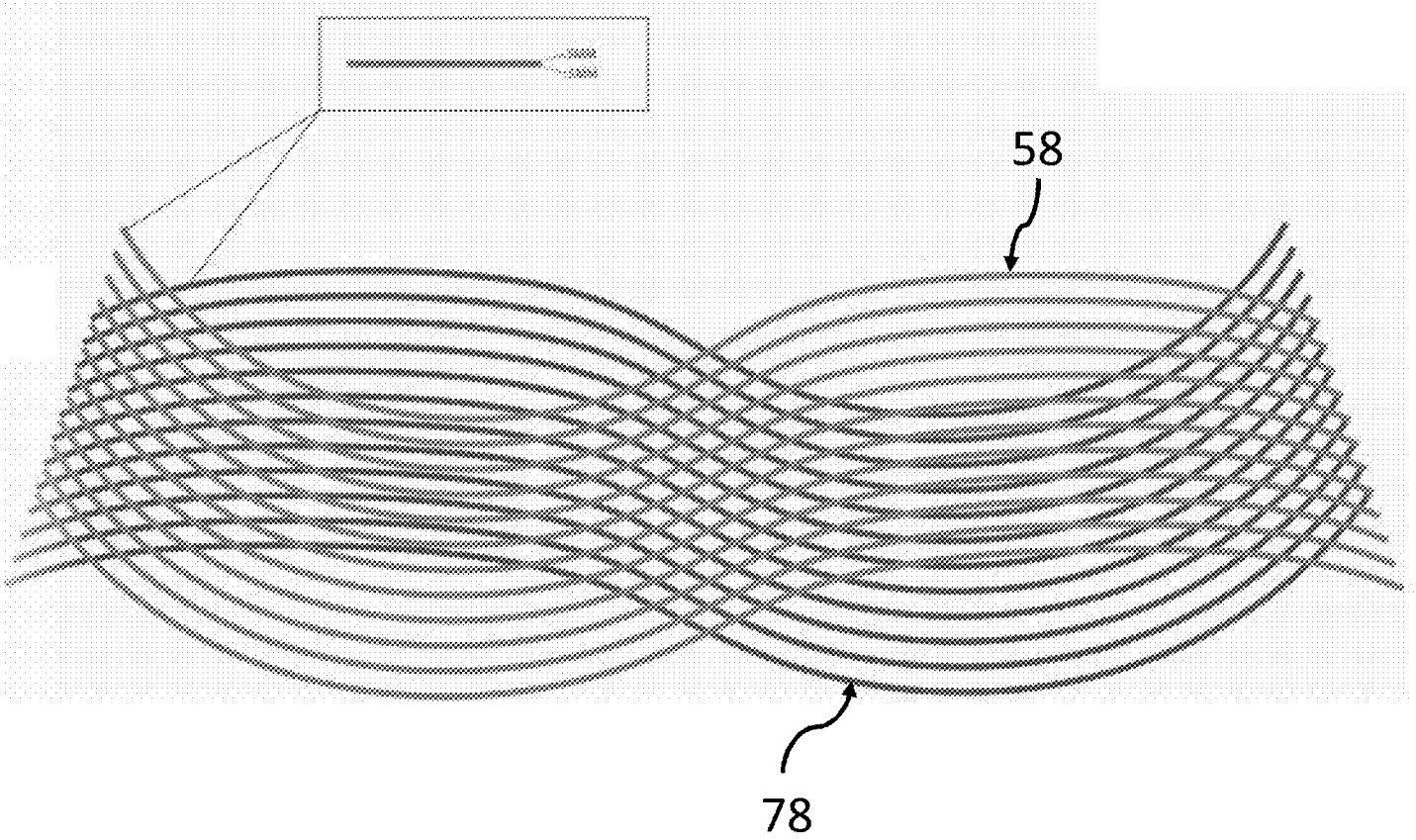
FIG. 4 shows plan view of an exemplary embodiment of a first pattern overlaid on a second pattern of the waistband of FIG. 1A.

FIG. 4 shows an exemplary embodiment of a first pattern 58 for the first polymer structure 56 and a second pattern 78 for the second polymer structure in the garment 20. In at least one embodiment, the first pattern 58 of the first polymer structure 56 is a plurality of wavy lines each separated by a predetermined distance (e.g., a series of waves similar to sine-waves generally nested together with each wave separated in a vertical direction by substantially the same distance). Similarly, the second pattern 78 of the second polymer structure 76 is also a plurality of wavy lines that are nested together with each of the waves separated by a predetermined distance. However, the second pattern 78 is generally offset from the first pattern 58, and thus the second pattern 78 may be considered either a leading or lagging version of the first pattern 58, or a symmetrical image of the first pattern 58. In this example, when the first layer 50 is aligned with the second layer 70 and the waistband 22 is closed, the first pattern 58 of the first polymer structure 56 is overlaid on the second pattern 78 of the second polymer structure 76, and various lines of the two patterns 58, 78 engage one another at intersection points. As a result, the corresponding waves of the two patterns come together to form a symbol that is similar to an infinity symbol (i.e., ∞), as shown in FIG. 4, due to a portion of the wavy lines from the two patterns engaging with one another. As can be seen in FIG. 4, the first pattern 58 includes a first series of generally horizontal wavy lines that are vertically spaced apart, the second pattern 78 includes a second series of generally horizontal wavy lines that are vertically spaced apart, wherein each of the generally horizontal wavy lines defines a trough portion on one side of the waistband 22 and a crest portion on an another side of the waistband with the trough portion and the crest portion together extending from a left hip portion to a right hip portion of the waistband. It will be recognized that different forms of the patterns 58, 78 are possible. In at least one embodiment, the first pattern 58 and the second pattern 78 are a plurality of wavy lines that are between 0.3 and 0.7 mm in thickness, between 1 mm and 5 mm in width, and each separated by a distance of 2.0 to 10.0 mm. For example, the first pattern 58 and the second pattern 78 may include a plurality of lines that are each 0.5 mm in thickness, 2.0 mm in width, and each separated by a distance of 4.0 mm. Furthermore, completely different patterns or shapes other than those shown in FIG. 4 are also possible in various embodiments.

With reference again to the exterior (outside) rear view of the garment 20 shown in FIG. 2, a portion of the first pattern 58 and the second pattern 78 is visible on the outside/exposed portion 74 of the second textile layer 70. A portion of the first pattern 58 and the second pattern 78 may also be visible on the outside/exposed surface 54 of the first textile layer 50. In one example, the first polymer structure 56 and the second polymer structure 76 are positioned on the anterior and posterior side of the waistband 22. As such, a portion of the first pattern 58 and a portion of the second pattern 78 may be visible along the rear of the waistband 22 when viewed from an outside perspective. In another example, the first polymer structure 56 and the second polymer structure 76 extend completely around and encircle the waistband 22. In this example, a portion of the first pattern 58 and a portion of the second pattern 78 may be visible from only outside a portion of the posterior side of the waistband 22 when viewed from an exterior perspective. In another example, the first polymer structure 56 and the second polymer structure 76 are positioned only in a portion of the anterior side and a portion of the posterior side of the waistband 22. In yet another example, the first polymer structure 56 and the second polymer structure 76 are positioned only in a portion of the anterior side or a portion of the posterior side of the waistband 22. Accordingly, it will be recognized that in various embodiments, the first and second polymer structures 56, 76 may be arranged differently, including in different patterns or shapes provided by the polymer structures, with such polymer structures located in different locations on the waistband 22.

With reference now to FIGS. 5-8, an alternative embodiment of the rear waistband portion 42 of FIGS. 1-4 is shown. Similar to the embodiment of FIGS. 1-4, the rear waistband portion 42 of FIGS. 5-8 is also configured to provide a lumbar portion of a garment. In this embodiment, a single fabric panel 80 is used to form the first layer 50 and the second layer 70 of the rear portion. Additionally, in this second embodiment, the first and second polymer structures 56 and 76 are specifically arranged on the single fabric panel 80 to provide unique advantages for the waistband.

Figure 5:
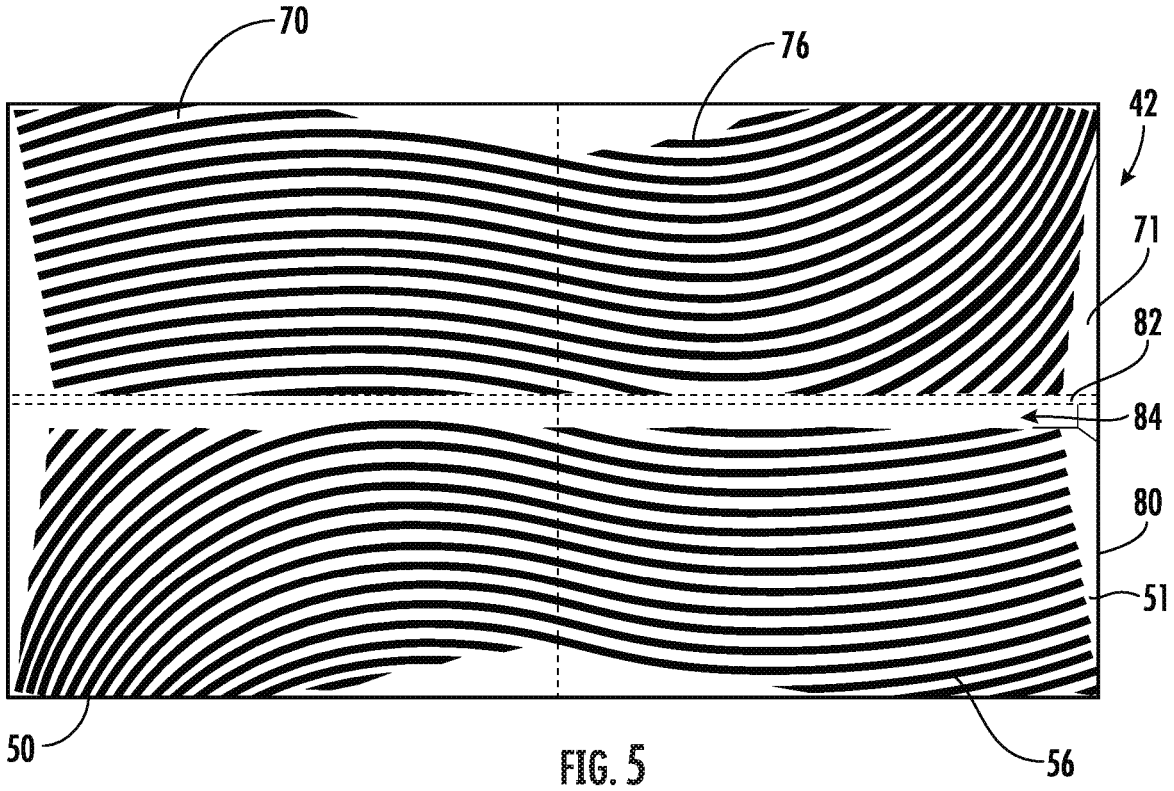
FIG. 5 shows a laid-open plan view of a lumbar portion of the waistband showing an alternative embodiment of the first pattern and the second pattern of FIG. 4.

FIG. 5 shows the single fabric panel 80 in a laid-open position. The panel 80 includes a first portion 51 used to form the first/inner layer 50 of the rear waistband portion 42, and a second portion 71 used to form the second/outer layer 70 of the rear waistband portion 42. The single fabric panel 80 is generally rectangular in shape and is defined by a centerline 82 (shown between two dotted lines in FIG. 5). The centerline 80 has a thickness but is positioned in the center of the single fabric panel. In other words, the distance from the centerline 82 to a first remote edge of the first portion 50 is substantially the same as (e.g., within about ¼ inch or less) the distance from the centerline 82 to a second remote edge of the second portion 71. In the disclosed embodiment, the centerline 82 provides a fold line for the fabric panel 80, the fold line having a width of about ⅛ inch. The fold line provides a top edge of the rear waistband portion 42. With the panel 80 folded along the centerline 82, the remote edge of the first portion 51 and second portion 71 are aligned and joined to other panels of the garment.

Figure 6:
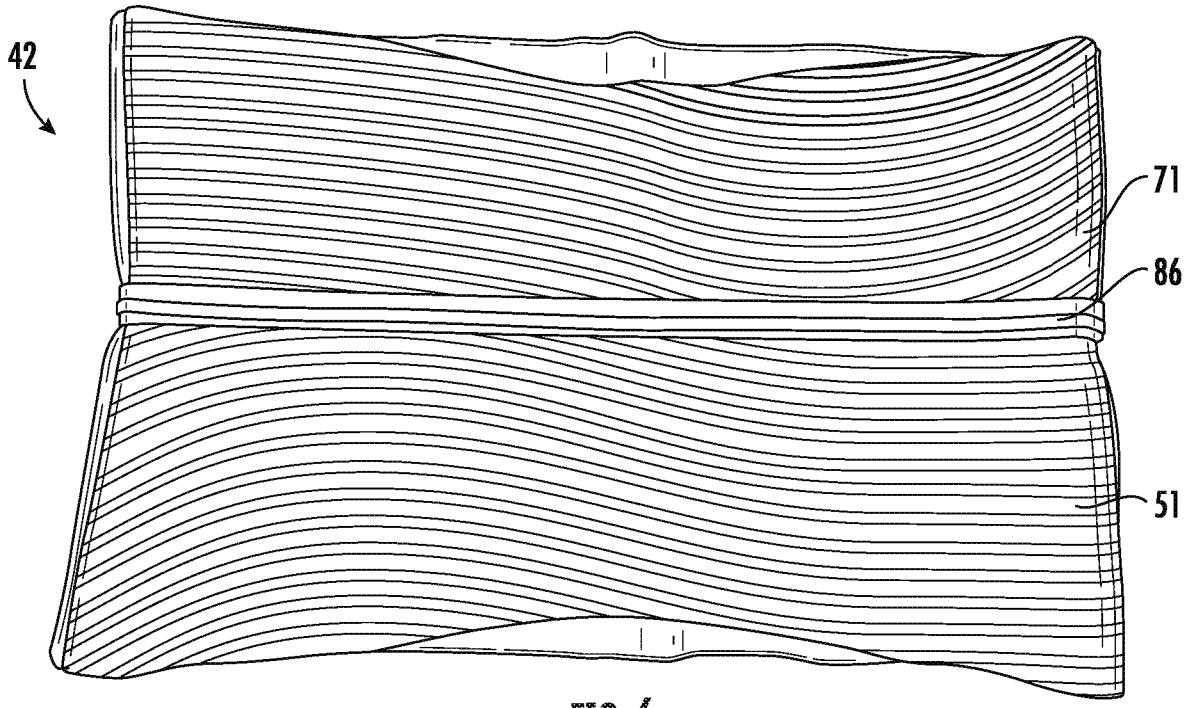
FIG. 6 shows a laid-open plan view of the waistband of FIG. 5 with an elastic strip extending across a top edge of an interior side of the inner layer of the waistband.

As shown in FIG. 5, the first polymer structure 56 is screen printed on the first portion 51 of the panel 80, and the second polymer structure 76 is screen printed on the second portion 71 of the panel 80. In at least one embodiment, the first and second polymer structures 56, 76 are comprised of a silicone material. The second polymer structure 76 extends all the way to the centerline 82 on the second portion 71 of the panel 80. However, a gap 84 is provided on the first portion 51 of the panel 80 between the first polymer structure 56 and the centerline 80. Accordingly, none of the first polymer structure 76 is provided in the gap 84. In at least one embodiment the gap is between ⅛ inch and ⅝ inch, and particularly about ⅜ inch. As shown in FIG. 6, the gap 84 allows for an elongated strip of elastic material 86 to be inserted in the gap and coupled to the panel 80. Accordingly, the elastic material 86 may be coupled to the panel 80 without any stitching piercing the first polymer structure 56 or any adhesive overlapping the first polymer structure 56.

Figure 7:
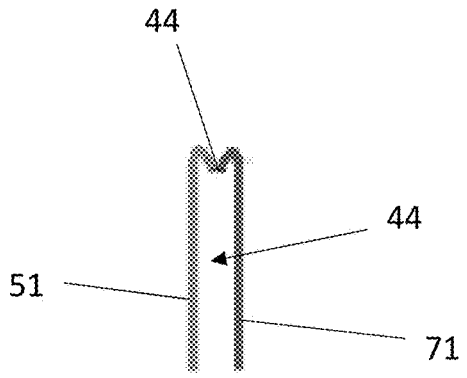
FIG. 7 shows a cross-sectional view of a pocket formed when the exterior panel of FIG. 6 is folded onto the interior panel.

With reference now to FIG. 7, when the panel 80 is folded along the centerline 82, the second portion 71 of the panel is generally aligned with and covers the first portion 51 of the panel 80. The first portion 51 forms the first layer 50 of the rear waistband portion 42, and the second portion 71 forms the second layer 70. Both the first and second polymer structures 56, 76 are provided within the pocket 44 (i.e., on the concealed sides of the first and second layers).

Figure 8:
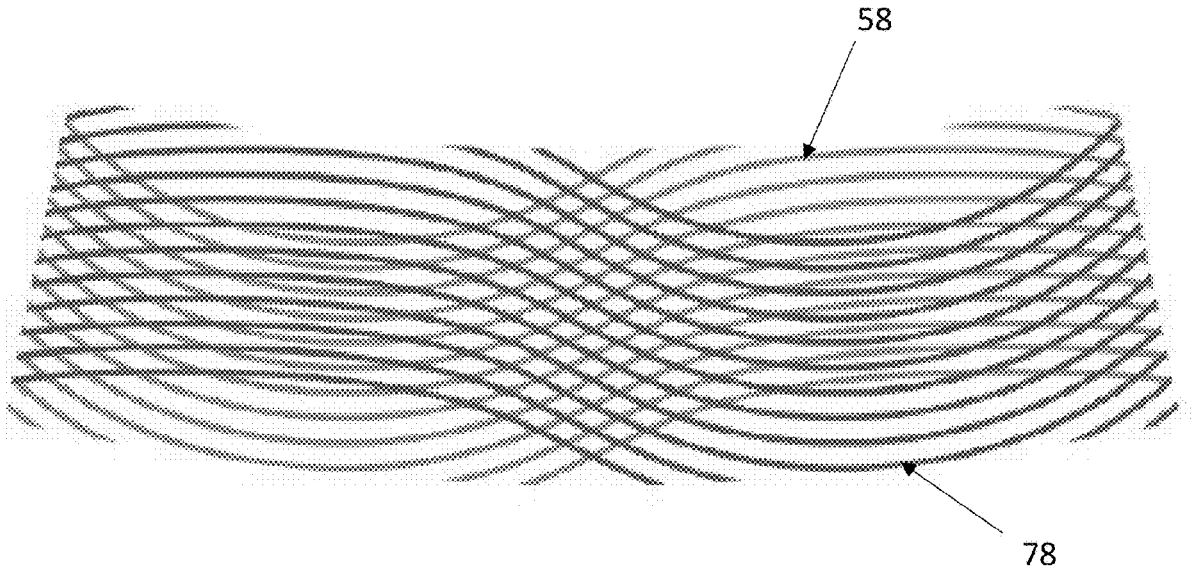
FIG. 8 shows a plan view of the first pattern in engagement with the second pattern of the waistband within the pocket of FIG. 7.

FIG. 8 shows a plan view of the first pattern provided by the first polymer structure 56 in engagement with the second pattern provided by the second polymer structure 76 within the pocket 44. This embodiment of the first pattern and the second pattern is similar to the embodiment of FIG. 4, but in the embodiment of FIG. 8, several of the wavy lines are interrupted. Additionally, in this embodiment, the wavy lines of the first polymer structure 56 are more offset from the wavy lines of the second polymer structure in a height direction because of the additional elastic strip 86 (not shown in FIG. 8). However, similar to FIG. 4, when the first pattern 58 of the first polymer structure 56 is overlaid on the second pattern 78 of the second polymer structure 76, various lines of the two patterns 58, 78 engage one another at intersection points. As a result, the corresponding waves of the two patterns come together to form a symbol that is similar to an infinity symbol (i.e., ∞), as shown in FIG. 8, due to a portion of the wavy lines from the two patterns engaging with one another. Because of the tacky nature of the silicone, a relatively high coefficient of friction exists at the intersection points, and the first layer 50 of the waistband is prevented from slipping relative to the second layer 70. Accordingly, because of the first and second polymer structures 56, 76, the first layer 50 of the rear waistband portion 42 is prevented from sliding relative to the second layer 70. Furthermore, as noted above, the intersection points as well as the general thickness of the polymer structures 56, 76 result in a perceptible texture on the exterior and the interior sides of the rear waistband portion 42.

Sleeve With a Digit Passage

Figure 9:
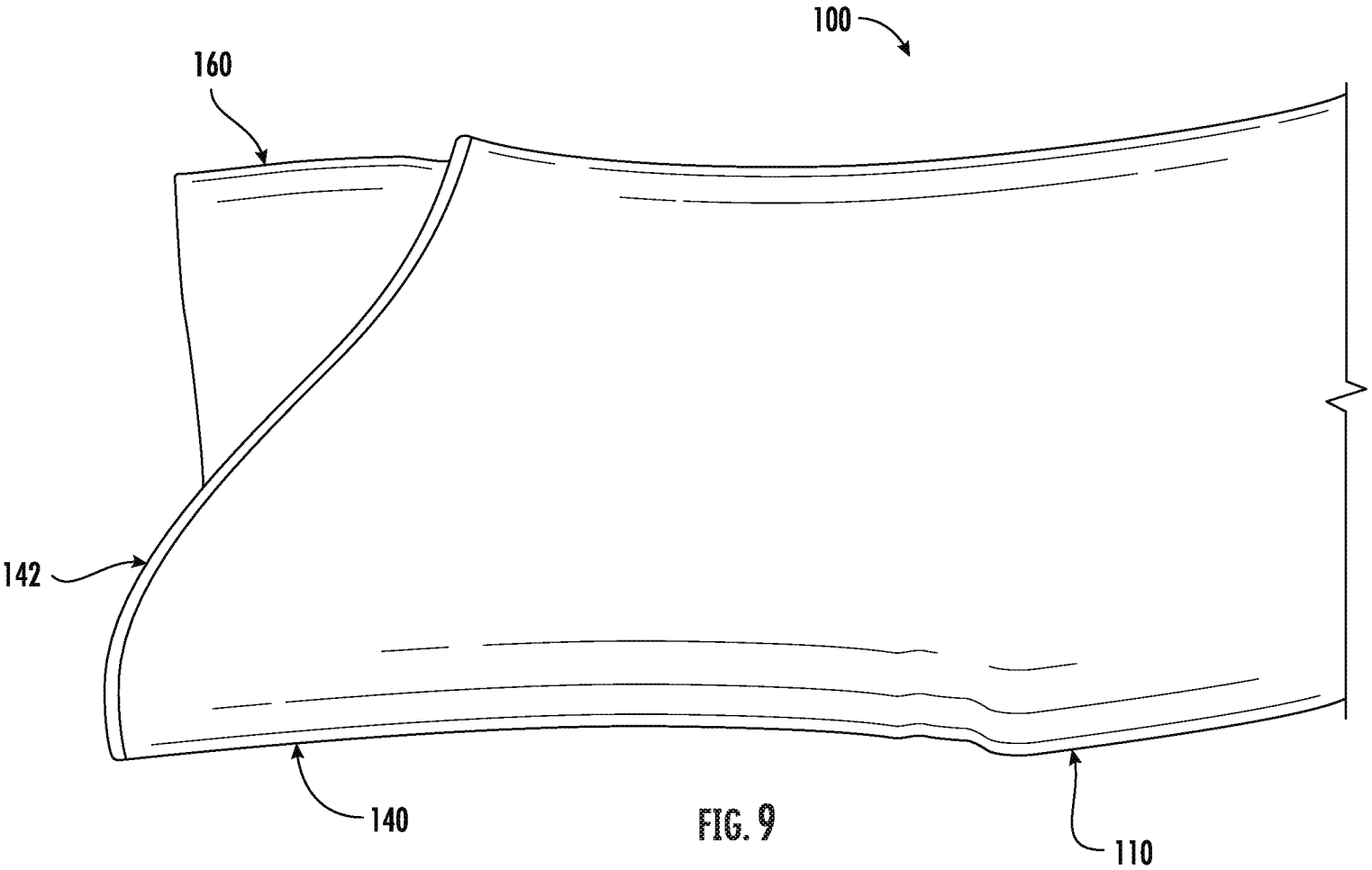
FIG. 9 is a side view of an exemplary embodiment of a sleeve provided on a garment which can be worn by a human, the sleeve including an adjustable passage.

FIG. 9 illustrates an exemplary embodiment of a garment 100 that includes a sleeve 110, which can be worn by a human wearer/user. As seen in FIG. 9, the sleeve includes a primary sleeve panel 140 including extending to the distal end of the sleeve 110 and a secondary sleeve panel 160 connected to the primary sleeve panel 140. The first edge 142 on the primary sleeve panel 140 overlaps portions of the secondary sleeve panel 160. As explained in further detail below, an opening 150 (not shown in FIG. 9) is formed between the primary sleeve panel 140 and the secondary sleeve panel 160. The opening is configured to receive a thumb or other digit on a hand of the user. When the thumb is not in the opening, the first edge 142 of the primary sleeve panel 140 covers the opening. When the thumb is in the opening, portions of the secondary sleeve panel 160 are pulled past the first edge 142 thus exposing the opening.

Figure 10A:
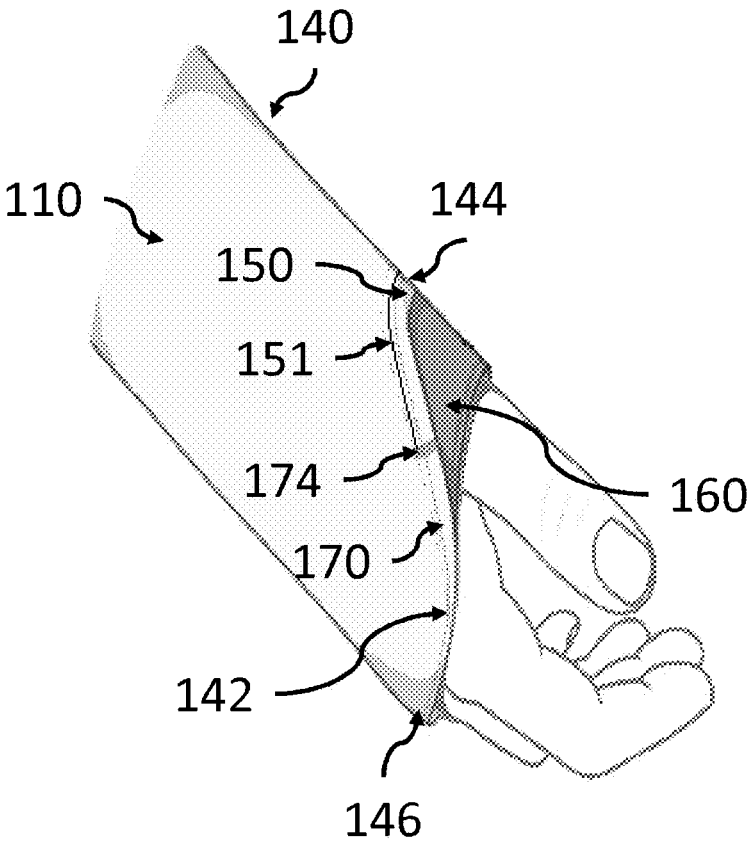
FIG. 10A is a thumb-side perspective view of the sleeve of FIG. 5 with the adjustable passage in a closed configuration.
Figure 10B:
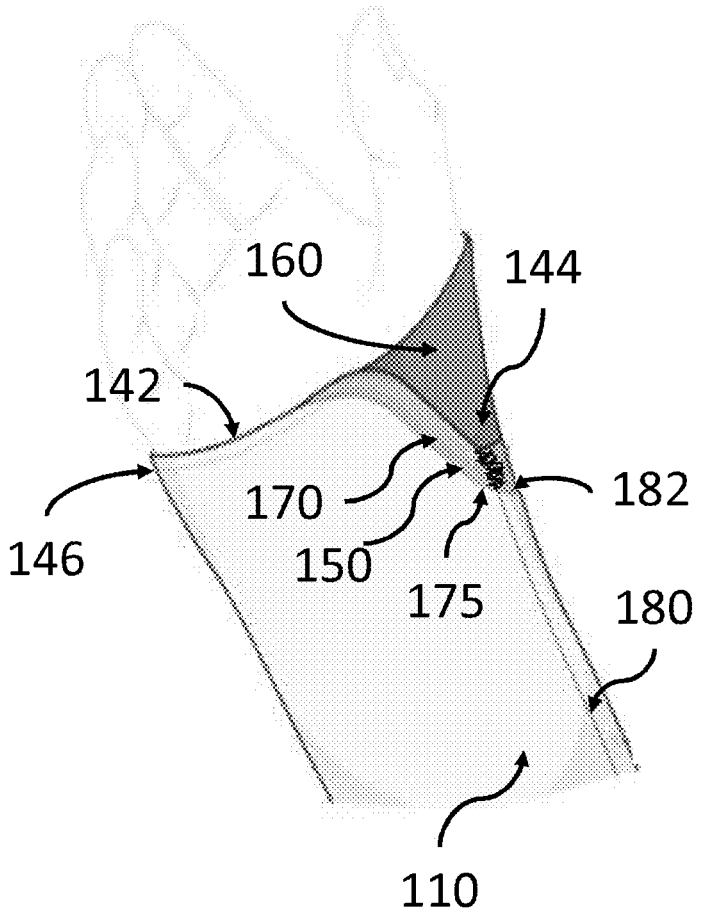
FIG. 10B is a palmer-side perspective view of the sleeve of FIG. 10A.
Figure 10C:
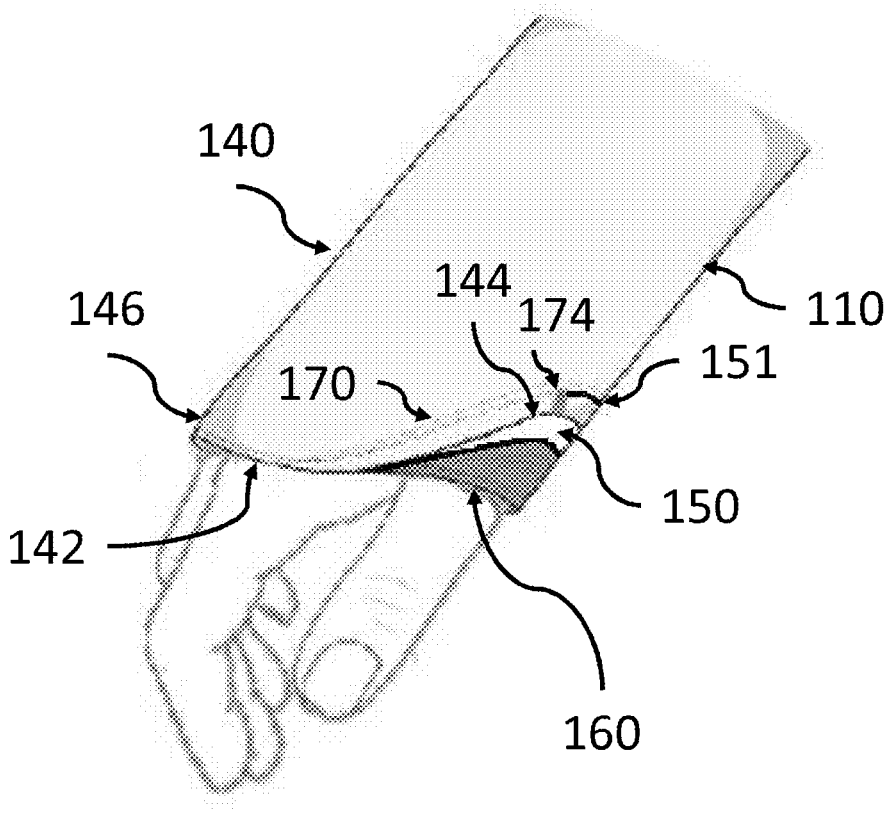
FIG. 10C is a palmer-side perspective view of the sleeve of FIG. 10A with the adjustable passage slightly opened to expose the passage.

FIGS. 10A-10C illustrate an exemplary embodiment of the sleeve 110. The primary sleeve panel 140 has a circuitous first edge 142 on the distal end of the sleeve 110. The first edge 142 includes a recessed portion 144 that extends along the thumb side of the first edge 142 and an extended portion 146 that extends along a pinky side of the first edge. As further illustrated in FIGS. 10A-10C, the extended portion 146 is more distal on the sleeve than the recessed portion 144. In one example, the extended portion 146 is a substantially straight (although circular) edge extending around the wrist of the user, and the recessed portion 144 forms an indentation along the first edge 142 that dips proximally into the sleeve 110 in the vicinity of the pad of the user's thumb. The recessed portion 144 extends for only a relatively short portion along the first edge 142 (e.g., 3-10 cm or 10%-40% of the distance around the edge 142), and the extended portion 146 extends for the remaining portion of the edge 142. Additionally, the recessed portion 144 recesses between 3-10 cm in the proximal direction in relation to the extended portion 146. It will be understood by one skilled in the art that the extended portion 146 and the recessed portion 144 can be formed using a combination of other patterns around the first edge 142 of the sleeve 110. For example, the first edge 142 may include a plurality extended portions 146 and recessed portions 144 for a plurality of fingers designed to slide through the sleeve 110.

With continued reference to FIGS. 10A-10C, the sleeve 110 includes a secondary sleeve panel 160 connected to the primary sleeve panel 140. A portion of secondary sleeve panel 160 may be connected to a portion of the primary sleeve panel 140 at a seam 170 arranged along the first edge 142, thus coupling the secondary sleeve panel 160 to the primary sleeve panel 140. The seam 170 may be provided in any of various forms, such as stitching, adhesives, or other methods of forming a seam as will be recognized by those of ordinary skill in the art. As noted in FIGS. 10A-10C, the seam 170 extends along both the dorsal and the palmar sides of the sleeve (i.e., relative to the user's hand), however, as explained in further detail below, the seam 170 includes an open length in the vicinity of the thumb portion, at the bottom of the recessed portion 144 of the primary sleeve panel 140. An overlap is formed between the primary sleeve panel 140 and the secondary sleeve panel 160 along the seam 170, and the overlap further extends completely around the recessed portion 144 such that the entire edge 142 is visible and exposed as it extends across the secondary sleeve panel 160. While the primary sleeve panel 140 has been described herein as overlapping the secondary sleeve panel 160, it will be recognized that in at least one embodiment the reverse is the case, and an edge of the secondary sleeve panel 160 overlaps the primary sleeve panel 140.

As shown in the embodiment of FIGS. 10A-10C, a portion of the secondary sleeve panel 160 is positioned in and extends across the recessed portion 144 of the primary sleeve panel 140 and fills the associated indentation. As a result, the primary sleeve panel 140 and secondary sleeve panel 160 together may be considered to form a distal edge of the sleeve 110. In another example, the entire secondary sleeve panel 160 may be tucked under the primary sleeve panel 140 such that the first edge 142 of the primary sleeve panel 140 alone forms the distal edge of the sleeve 110.

As noted previously, a portion of the secondary sleeve panel 160 is connected to a portion of the primary sleeve panel 140 at the seam 170 along the proximal edge of the secondary sleeve panel 160. However, another portion of the proximal edge of the secondary sleeve panel 160 is not connected to the primary sleeve panel 140 and is actually moveable relative to the first edge 142 of the primary sleeve panel 140. This moveable portion of the secondary sleeve panel 160 results in an adjustable opening 150, and particularly a thumb passage 150, being formed at the thumb side of the first edge 142. As noted by the line 151 in FIGS. 10A-10C, this adjustable passage 150 is located along the seam 170 between two reinforcements provided at two coupling terminals 174 and 175 in the seam 170 that define edges of the passage 150. The seam 170 does not join the primary sleeve panel 140 to the secondary sleeve panel 160 along this length between the two reinforcements. FIG. 10C shows the secondary sleeve panel 160 pulled away from the primary sleeve panel 140 between the reinforcements at the coupling terminals 174 and 175 of the seam 170, thus exposing the passage 150 in a slightly opened configuration.

The sleeve panels 140 and 160 are each formed from a sheet of material, such as a textile, leather, synthetic sheet, or other material. In at least one embodiment, one or more of the sleeve panels 140 and 160 are comprised of an elastic textile, such as spandex or other textile including elastane fibers. Accordingly, the sleeve panels 140 and 160 may be stretched by the user and then subsequently rebound to an equilibrium position. Therefore, it will be appreciated that application of a force to one or more of the fabric panels 140, 160 may cause such panels to be stretched in order to enlarge the passage 150 to a much greater degree than that shown in FIG. 10C. When the force is removed, the resilient panels 140, 160 return to their equilibrium configuration.

In the embodiment of FIGS. 10A-10C, the seam 170 is arranged along the extended portion 146 and the recessed portion 144 of the first edge 142, and the passage 150 is formed near the inflection point of the recessed portion 144. The passage 150 is formed in the overlap where a portion of the secondary sleeve panel 160 is not connected to a portion of the primary sleeve panel 140. A portion of the overlap between the primary sleeve panel 140 and the secondary sleeve panel 160 is not connected at a seam 170 but is instead left open to form a passage 150. The passage 150 is designed and dimensioned to receive the thumb of the human. In at least one alternative embodiment, a plurality of passages 150 can be designed and dimensioned in the sleeve so that a plurality of fingers of the human can slip through the passages 150. In this example, the first edge 142 can be contoured with different indentations to allow multiple fingers to slide through the plurality of passages 150.

In at least one embodiment, the secondary sleeve panel 160 includes a 2-ply underlayer that is seamed to the primary sleeve panel 140 in certain portions of the first edge 142. For example, the secondary sleeve panel 160 may be joined at a seam 170 to the primary sleeve panel 140 on the extended portion 146 of the first edge 142. Again, a length of the recessed portion 144 of the first edge 142 is left open to form a passage 150 through the seam 170 (i.e., a length extending between two coupling terminals 174, 175). The length that is left open to form the passage 150 is sufficient to allow passage of a human thumb through the seam 170. For example, in at least one embodiment, the length that is left open to form the passage may be between one and three inches. In any event, the reinforcements can be used at the coupling terminals 174, 175 of the seam 170 to reinforce the area of the sleeve 110 and secure the seams. The reinforcements can include a clean tack, bartack or any other device to secure the seams 170. In one example, the reinforcement 174, 175 may be visible when the sleeve 110 is viewed from an external perspective. In another example, the reinforcement may provider an indicator mark for the wearer to indicate open passages 150 in the sleeve through which a plurality of fingers can slide through.

In at least one embodiment, a portion 182 of the recessed portion 144 where the passage 150 is located in the vicinity of the thumb defines a clean outline around the base of the thumb or thumb pad. In other words, the edge of the fabric defines a circular edge that follows the shape of thumb at the base of the thumb or thumb pad. In another alternative embodiment, the portion 182 of recessed portion 144 defines a square outline around the base of the thumb and is squared off. It will be recognized by one skilled in the art that the recessed portion where the passage 150 is located can have other patterns. These patterns would allow the fingers to slide through the passages 150 easily and provide comfort to the fingers when the fingers are received through the passages 150. In one example, a seam 180 extends horizontally under the recessed portion 144 and the coupling terminals 174, 175 of the seam 170 is provided at this location.

Figure 11A:
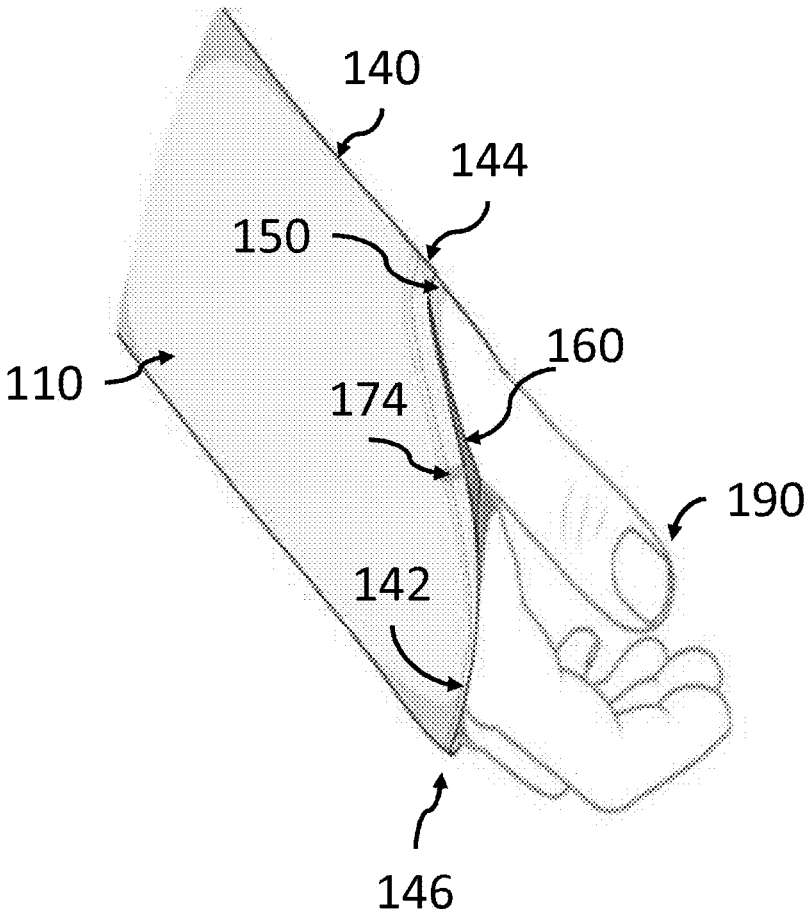
FIG. 11A is a thumb-side perspective view thumb of the sleeve of FIG. 10A with a thumb of the wearer extending through the passage such that the passage is in an open configuration.
Figure 11B:
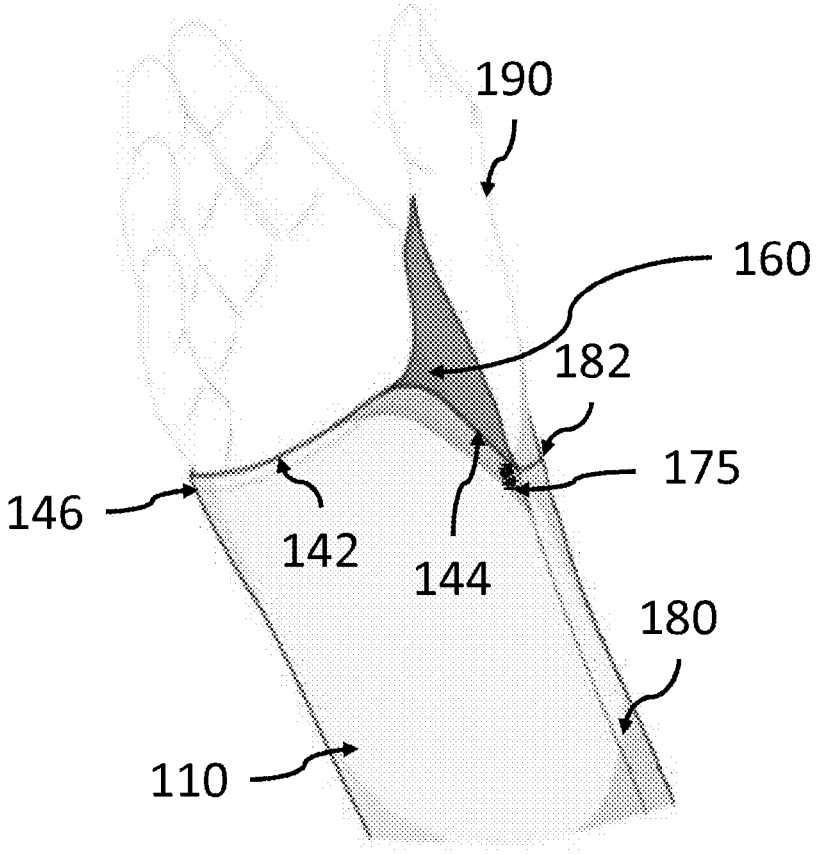
FIG. 11B is a palmer-side perspective view of the sleeve of FIG. 11A.

FIGS. 7A-7B illustrate an exemplary embodiment of the sleeve 110 when a finger of the wearer slips through the passage 150. In FIGS. 11A and 11B, the thumb 190 of the wearer is inserted through the passage 150 between the primary sleeve panel 140 and the secondary sleeve panel 160 such that a portion of the secondary sleeve panel 160 extends over the Purlicue (i.e., the tissue in the space between the thumb 190 and index finger). In order to arrive at this position, the thumb 190 slides between the primary sleeve panel 140 and the secondary sleeve panel 160, between the reinforcements at the coupling terminals 174 and 175 of the seam 170, and catches the secondary sleeve panel 160 at the passage 150. Advantageously, the material used to form the secondary sleeve panel 160 has sufficient elasticity to allow the user to stretch the secondary sleeve panel over the thumb and arrive at this position. It should be understood by one skilled in the art that the passage 150 can be located in other locations between the primary sleeve panel 140 and the secondary sleeve panel 160 to allow other fingers of the wearer to slide through the sleeve 110.

As noted previously, the recessed portion 144 of the first edge 142 may include the squared off portion 182 of the primary sleeve panel 140 when the thumb 190 slips through the passage 150. When the thumb 190 slips through the passage 150, the squared off portion 182 provides a clean tack and a clean outline of the thumb 190 and provides a comfort fit around the thumb 190 without panels 140, 160 stretching or providing tension on the thumb 190. As further illustrated in FIG. 11B, the seam 180 extending below the portion 182 provides an aesthetic look to the sleeve 110. The seam 180 also provides an indicator to the wearer to indicate where the open passage 150 is located between the primary sleeve panel 140 and the secondary sleeve panel 160.

Figure 12B:
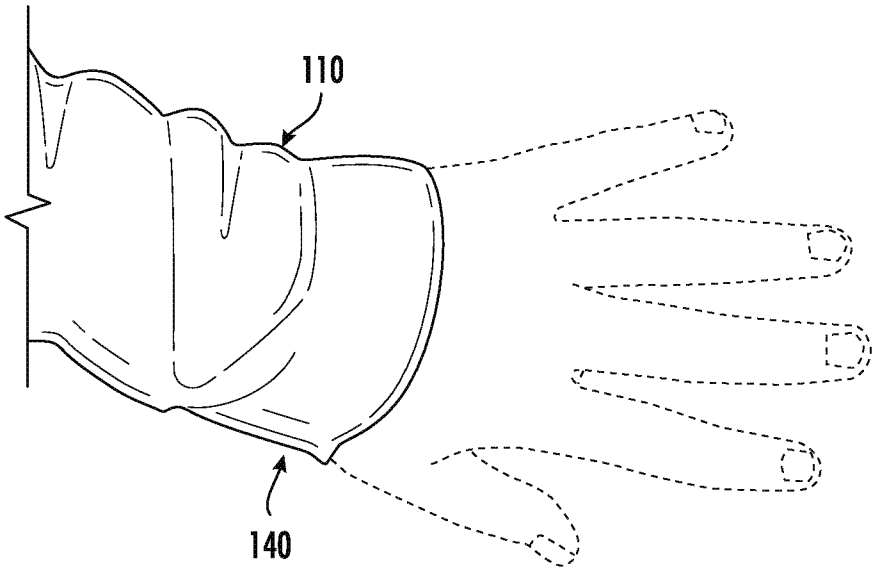
FIG. 12B shows a dorsal-side perspective view of the sleeve of FIG. 12A.
Figure 12A:
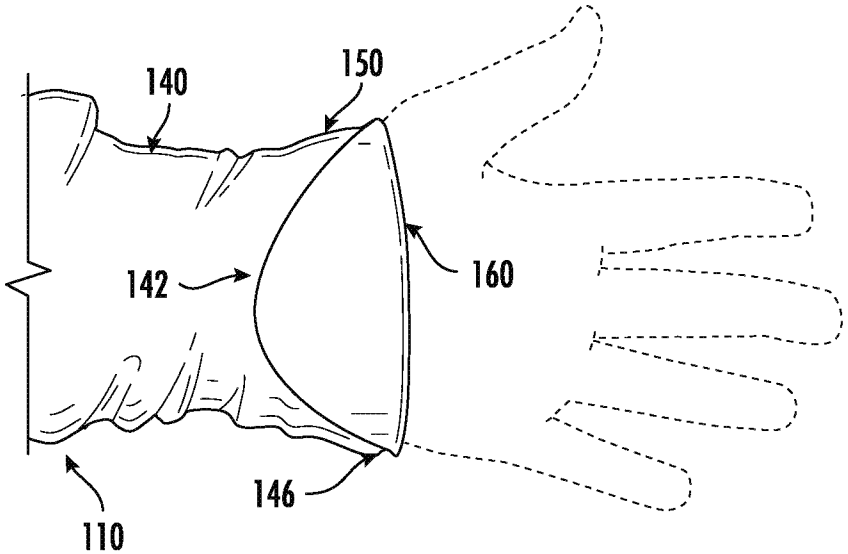
FIG. 12A shows a palmer-side perspective view of a second exemplary embodiment of the sleeve of FIG. 5 with the adjustable passage in a closed configuration.
Figure 12C:
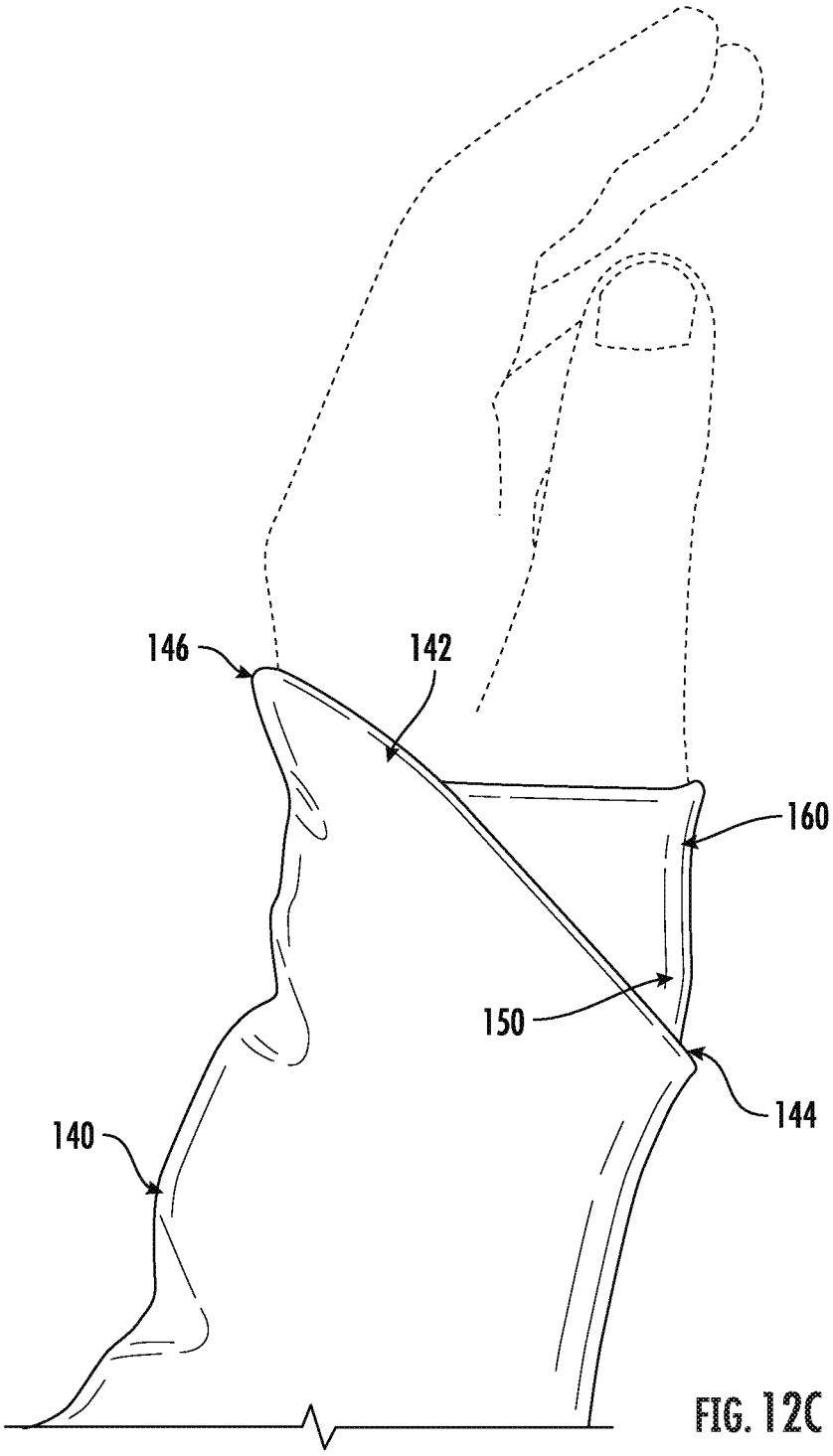
FIG. 12C shows a thumb-side perspective view of the sleeve of FIG. 12A.

FIGS. 12A-12C show the sleeve 110 in at least one embodiment wherein a hand extends through the sleeve, but the thumb 190 does not extend through the passage 150 of the sleeve 110. As seen in FIGS. 12A-12C, the primary sleeve panel 140 is generally contiguous and somewhat overlapping to the secondary sleeve panel 160 and forms part of the distal edge of the sleeve 110 when the thumb is not slipped through the passage 150. Due to the overlap between the secondary sleeve panel 160 and the primary sleeve panel 140, the passage 150 remains hidden when the thumb is not slipped through the passage 150. With particular reference to FIG. 12C, the overlap of the secondary sleeve panel 160 and the primary sleeve panel 140 covers the passage 150 and the primary sleeve panel 140 and the secondary sleeve panel 160 form a contiguous sleeve 110 with no visible passage (i.e., the passage 150 is not visible when the thumb is not in the passage).

Figure 13B:
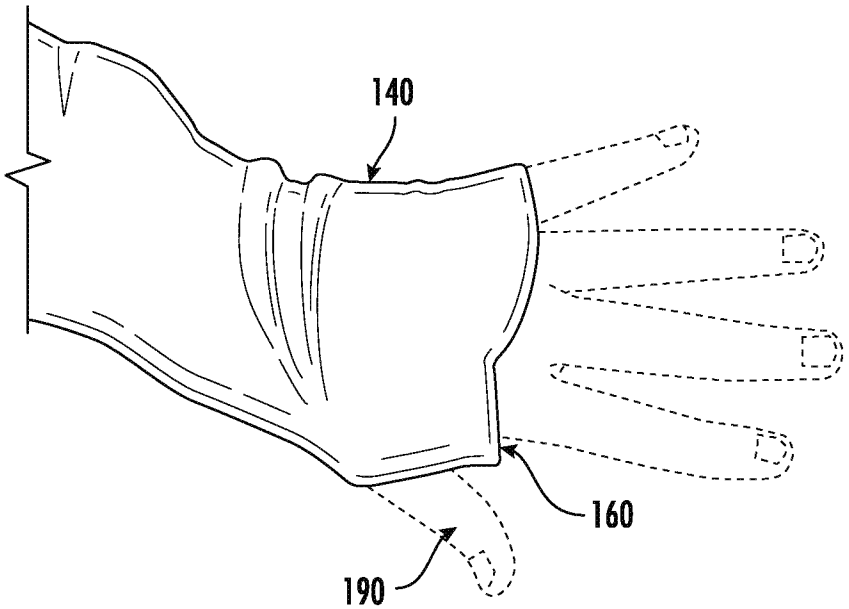
FIG. 13B shows a dorsal-side perspective view of the sleeve of FIG. 13A.
Figure 13A:
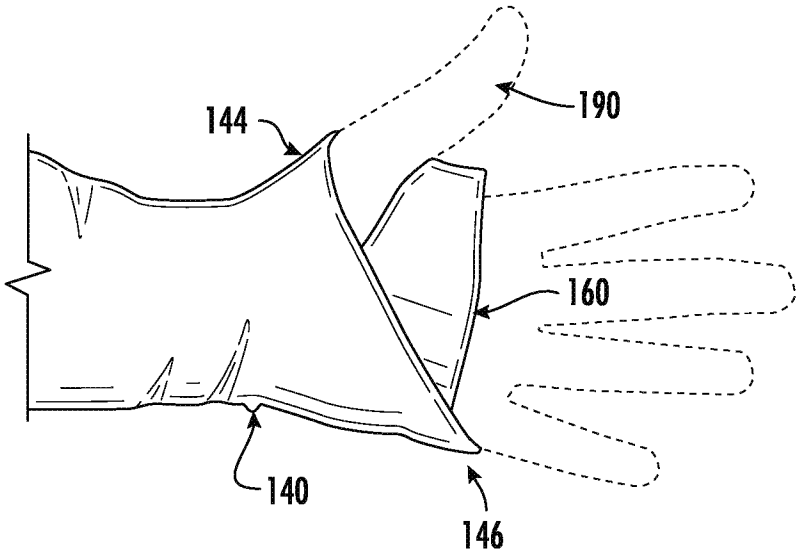
FIG. 13A shows a palmer-side perspective view of the sleeve of FIG. 12A with a thumb of the user extending through the passage such that the passage is in an open configuration.
Figure 13C:
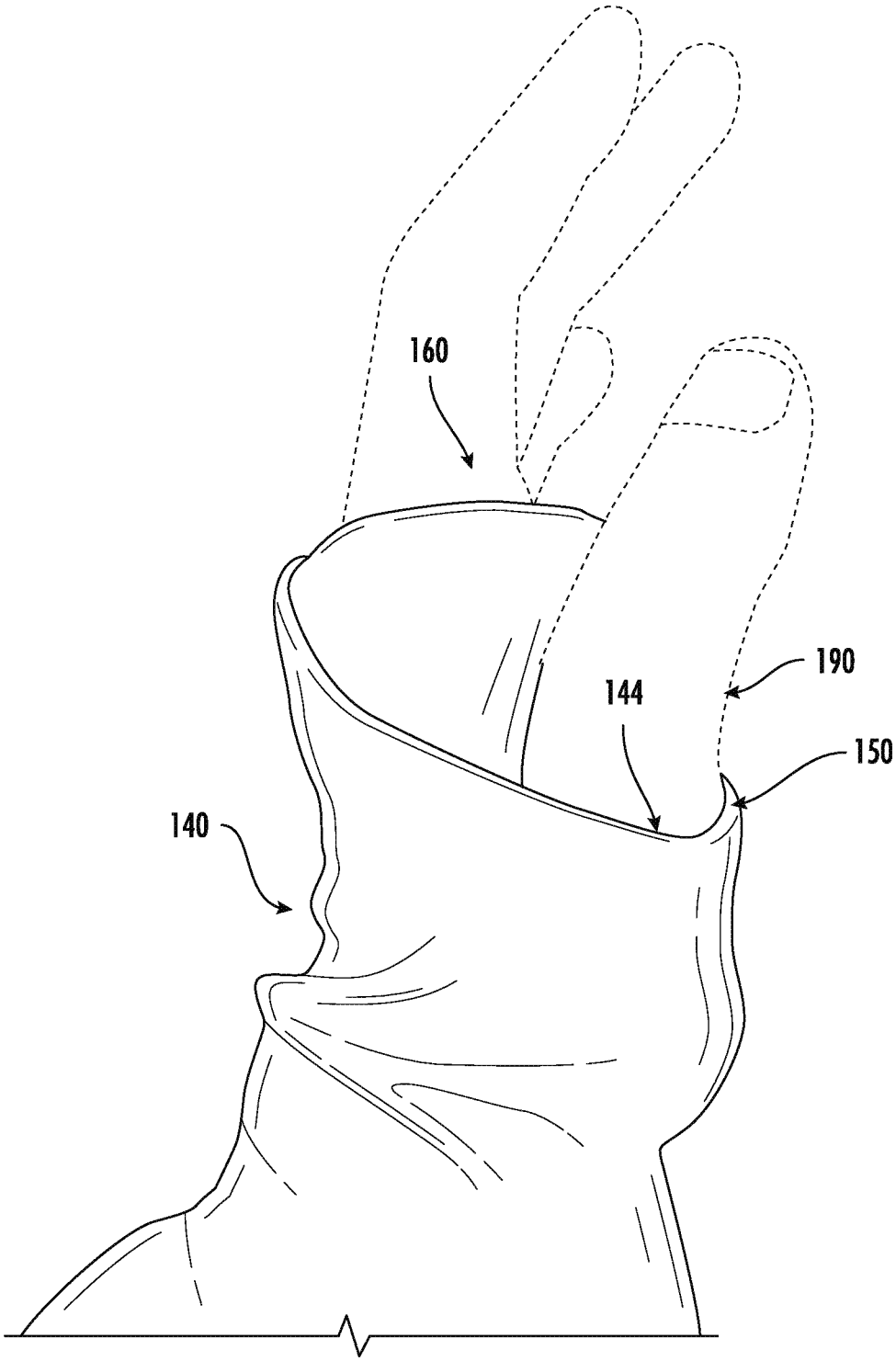
FIG. 13C shows a thumb-side perspective view of the sleeve of FIG. 13A.

FIGS. 13A-13C show an exemplary embodiment of the sleeve 110 when the thumb 190 is extended through the passage 150. As seen in FIGS. 13A-13C, the thumb 190 catches the open portion of the overlap of the primary sleeve panel 140 and the secondary sleeve panel 160, slides through the passage 150 formed by the opening, and extends outwardly from the passage 150.

The foregoing detailed description of one or more exemplary embodiments of the garment including a textured waist portion and the garment including a sleeve with a thumbhole has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed exemplary embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the exemplary embodiments contained herein.

What is claimed is:

1. A garment comprising:

a waistband including:

a first layer including a concealed surface and an exposed surface, the exposed surface of the first layer configured to be in contact with a skin of a wearer;

a second layer including a concealed surface and an exposed surface, the second layer secured to the first layer at an upper end and a lower end to form the waistband, and wherein a closed pocket is formed between the first layer and the second layer with the concealed surface of the first layer and the concealed surface of the second layer being positioned within the closed pocket;

a first polymer structure disposed on the concealed surface of the first layer; and a second polymer structure disposed on the concealed surface of the second layer such that the first polymer structure releasably engages the second polymer structure; and at least one fabric panel coupled to the waistband.

2. The garment of claim 1, wherein the first polymer structure forms a first pattern and the second polymer structure forms a second pattern.

3. The garment of claim 2, wherein the first pattern is a first plurality of wavy lines separated by a predetermined distance, wherein the second pattern is a second plurality of wavy lines separated by a distance, and wherein the second pattern is overlaid on the first pattern such that the first pattern and the second pattern together form an infinity symbol.

4. The garment of claim 3 wherein the first plurality of wavy lines are defined by a first series of generally horizontal wavy lines that are vertically spaced apart, wherein the second plurality of wavy lines are defined by a second series of generally horizontal wavy lines that are vertically spaced apart, and wherein each of the generally horizontal wavy lines defines a trough portion on one side of the waistband and a crest portion on an another side of the waistband with the trough portion and the crest portion together extending from a left hip portion to a right hip portion of the waistband.

5. The garment of claim 2, wherein the first polymer structure and the second polymer structure are between 0.3 mm and 0.7 mm in thickness, between 1 mm and 5 mm in width, and a portion of outline of the first pattern and the second pattern are visibly or tactilely perceivable to a human on the exposed surfaces of the first layer and the second layer.

6. The garment of claim 2, wherein a portion of the first pattern and a portion of the second pattern overlap.

7. The garment of claim 1 wherein the first polymer structure is a first layer of polyurethane and the second polymer structure is a second layer of polyurethane.

8. The garment of claim 1 wherein the at least one fabric panel includes at least one leg panel, and wherein the first layer and the second layer both include elastane fibers.

9. The garment of claim 1 wherein the waistband includes an anterior side and a posterior side, wherein the first polymer structure and the second polymer structure are positioned on the posterior side of the waistband without extending to the anterior side of the waistband.

10. The garment of claim 1 wherein the first polymer structure is disposed on a middle of the first layer between the upper end and the lower end, wherein the second polymer structure is disposed on a middle of the second layer between the upper end and the lower end, and wherein the first polymer structure and the middle of the first layer are freely moveable with respect to the second polymer structure and the middle of the second layer.

11. A garment comprising:

a multi-layer waistband including:

a first layer including a first concealed surface and a first exposed surface, the first layer including a middle portion positioned between an upper end and a lower end;

a second layer including a second concealed surface and a second exposed surface, the second layer including a middle portion positioned between an upper end and a lower end, wherein the upper end of the first layer is connected to the upper end of the second layer, wherein the lower end of the first layer is connected to the lower end of the second layer, wherein the middle portion of the first layer is freely moveable relative to the middle portion of the second layer, and wherein the upper end of the first layer is connected to the upper end of the second layer along an upper horizontal seam, and wherein the lower end of the first layer is connected to the lower end of the second layer along a lower horizontal seam;

a first polymer structure disposed on the first concealed surface at the middle portion of the first layer; and a second polymer structure disposed on the second concealed surface at the middle portion of the second layer such that the first polymer structure releasably engages the second polymer structure; and at least one fabric panel coupled to the waistband.

12. The garment of claim 11, wherein the first polymer structure is a first plurality of wavy lines separated by a predetermined distance, wherein the second polymer structure is a second plurality of wavy lines separated by a distance, and wherein the second plurality of wavy lines is overlaid on the first plurality of wavy lines such that the first pattern and the second pattern together form an infinity symbol.

13. The garment of claim 12 wherein the first plurality of wavy lines are defined by a first series of generally horizontal wavy lines that are vertically spaced apart, wherein the second plurality of wavy lines are defined by a second series of generally horizontal wavy lines that are vertically spaced apart, and wherein each of the generally horizontal wavy lines defines a trough portion on one side of the waistband and a crest portion on an another side of the waistband with the trough portion and the crest portion together extending from a left hip portion to a right hip portion of the waistband.

14. The garment of claim 13, wherein each of the first plurality of wavy lines and the second plurality of wavy lines are between 0.3 mm and 0.7 mm in thickness, and between 1 mm and 5 mm in width.

15. The garment of claim 11 wherein the first polymer structure and the second polymer structure are tactilely perceivable to a human via the first exposed surface and the second exposed surface.

16. The garment of claim 11 wherein the first polymer structure is a first layer of polyurethane and the second polymer structure is a second layer of polyurethane.

17. The garment of claim 11 wherein the at least one fabric panel includes at least one leg panel, and wherein the first layer and the second layer both include elastane fibers.

18. The garment of claim 11 wherein the waistband includes an anterior side and a posterior side, wherein the first polymer structure and the second polymer structure are positioned on the posterior side of the waistband without extending to the anterior side of the waistband.

19. A multi-layer waistband extending between a left hip portion and a right hip portion of a garment, the multi-layer waistband including:

a first layer including a first concealed surface and a first exposed surface, the first layer including a middle portion positioned between an upper end and a lower end of the first layer;

a second layer including a second concealed surface and a second exposed surface, the second layer including a middle portion positioned between an upper end and a lower end of the second layer, the upper end of the first layer non-releasably connected to the upper end of the second layer, the lower end of the first layer non-releasably connected to the lower end of the second layer, and the middle portion of the first layer freely moveable relative to the middle portion of the second layer, and wherein a closed pocket is formed between the first layer and the second layer with the first concealed surface and the second concealed surface being positioned within the closed pocket;

a first polymer structure disposed on the first concealed surface at the middle portion of the first layer, the first polymer structure including a first plurality of wavy lines; and a second polymer structure disposed on the second concealed surface at the middle portion of the second layer, the first polymer structure including a second plurality of wavy lines, wherein the first plurality of wavy lines are in releasable engagement with the second plurality of wavy lines.

20. The multi-layer waistband of claim 19, wherein the engagement of the first plurality of wavy lines and the second plurality of wavy lines forms an infinity symbol that is tactilely perceivable via at least one of the first exposed surface and the second exposed surface.

* * * * *